US009105169B2

(12) United States Patent
Hanning

(10) Patent No.: US 9,105,169 B2
(45) Date of Patent: Aug. 11, 2015

(54) ALARM SYSTEM FOR PASSAGEWAYS

(76) Inventor: Jeffrey L. Hanning, Clovis, CA (US)

( * ) Notice: Subject to any disclaimer, the term of this patent is extended or adjusted under 35 U.S.C. 154(b) by 0 days.

(21) Appl. No.: 12/460,032

(22) Filed: Jul. 10, 2009

(65) Prior Publication Data

US 2015/0091728 A1 Apr. 2, 2015

(51) Int. Cl.
*G08B 13/18* (2006.01)
*G08B 13/19* (2006.01)

(52) U.S. Cl.
CPC ..... *G08B 13/19* (2013.01)

(58) Field of Classification Search
CPC ... A61K 31/198; A61K 31/221; A61K 45/06; A61K 47/36; E04H 4/065; G08B 13/19; A43B 3/126; A47K 1/04; A61J 17/00; A61J 17/001; A61J 1/1418; A61J 2017/001; B02C 18/302; B60P 3/32; B60R 22/28
USPC ..... 340/552, 556, 557, 555, 551, 545.8, 340/545.9, 550, 561, 571, 572.7, 328
See application file for complete search history.

(56) References Cited

U.S. PATENT DOCUMENTS

| | | | | |
|---|---|---|---|---|
| 4,516,115 | A | 5/1985 | Frigon et al. | |
| 4,719,363 | A | 1/1988 | Gallacher | |
| 4,922,168 | A | 5/1990 | Waggamon et al. | |
| 5,517,176 | A | 5/1996 | Lavelle et al. | |
| 5,656,900 | A | 8/1997 | Michel et al. | |
| 6,255,946 | B1 * | 7/2001 | Kim | 340/556 |
| 7,164,354 | B1 * | 1/2007 | Panzer | 340/539.15 |
| 7,466,217 | B1 * | 12/2008 | Johnson et al. | 340/425.5 |
| 8,225,458 | B1 * | 7/2012 | Hoffberg | 16/49 |
| 2002/0032996 | A1 * | 3/2002 | Cornwall | 52/220.8 |
| 2009/0151258 | A1 * | 6/2009 | Andersen | 49/281 |
| 2009/0188435 | A1 * | 7/2009 | Hale, Jr. | 119/484 |
| 2009/0249693 | A1 * | 10/2009 | Al-Qassem | 49/13 |

OTHER PUBLICATIONS

Poolguard Door Alarm—Model DAPT-WT, Internet, Jun. 27, 2009, 2 pages, U.S.
Poolguard Door Alarm—Model DAPT-2, Internet, Jun. 27, 2009, 2 pages, U.S.

* cited by examiner

*Primary Examiner* — Daniel Previl
(74) *Attorney, Agent, or Firm* — Richard A. Ryan

(57) ABSTRACT

An improved alarm system for monitoring movement through a passageway defined by opposing sidewalls comprises a lower passage indicator disposed toward the lower ends of the sidewalls, an upper passage indicator disposed toward the upper ends of the sidewalls and a control mechanism configured to sound an alarm if one of the passage indicators indicates passage through the passageway and the other passage indicator does not. In a preferred embodiment, the alarm system is configured as a pool alarm and each passage indicator comprises an emitter/receiver that emits an infrared beam toward an opposing reflector to provide a lower beam and an upper beam. If only the lower beam is interrupted, indicating a child passing through the passageway, the control mechanism will generate an alarm signal. If both beams are interrupted, indicating an adult passing through the passageway, the control mechanism will not generate the alarm signal.

20 Claims, 5 Drawing Sheets

ALARM SYSTEM FOR PASSAGEWAYS

CROSS-REFERENCE TO RELATED APPLICATIONS

None.

STATEMENT REGARDING FEDERALLY SPONSORED RESEARCH

Not Applicable.

BACKGROUND OF THE INVENTION

A. Field of the Invention

The field of the present invention relates generally to devices and systems for electronically monitoring ingress and egress through a passageway, such as door openings and the like. More particularly, the present invention relates to such devices and systems wherein the interruption of a beam of radiation, such as a beam of infrared energy, activates an alarm signal or causes other action upon the entry or exit of a person through the passageway. Even more particularly, the present invention relates to such devices and systems that are specially configured as an alarm for a passageway leading to a pool or other potentially dangerous area.

B. Background

In general, devices and systems for the detection of persons, pets or other objects through a passageway are well known in the art. Such devices and systems are typically utilized to prevent unauthorized entry into a restricted area or unauthorized exit from a safe or otherwise controlled area. For purposes of the present invention, the term "passageway" includes a doorway, window, gate and any other type of opening which is defined by a pair of opposing and spaced apart sidewalls through which a person, pet or other object may pass. Typically, but not exclusively, passageways are defined by a frame, such as a door frame or window sill, that includes the opposing sidewalls and at least a top wall. Although the opposing sidewalls are usually configured to be generally vertical, the term "passageway" is not limited to vertical sidewalls and includes sidewalls that may deviate quite substantially from a vertical orientation. As well known in the art, a home, business or other building may have a number of passageways, including the front door, rear door, side door and windows. Generally, one or more of the building's passageways are selected to be monitored by an ingress/egress monitoring system.

The area for which ingress or egress into or out of is desired to be monitored can be any type of area, whether it is located inside a building or outside of a building. Often, the entry into or exit from the area is restricted to certain persons or certain types of persons so as to protect those who are inside the building from unauthorized entry by others or to determine when a person inside the building exits out of the building without authorization. One example of the use of such monitoring systems is an alarm system that detects the entry of unauthorized persons into a home, office or other structure. Another example of the use of such monitoring systems is an alarm system that detects when a person exits the structure through a passageway when he or she is not allowed to exit, such as an alarm system connected to the rear or emergency door of a store or the like. There is a wide variety of different configurations of such alarm systems that utilized various detection and alarm devices. Generally, however, a common feature of these types of alarm systems is that they are configured to detect the unauthorized ingress or egress of any person who passes through the passageway without first deactivating the alarm system. Some of these alarm systems utilize the unauthorized opening of a door or window to indicate a person passing through the passageway and the activation of the alarm. Other alarm systems utilize the direct movement of a person or other object through the passageway, usually detected by a motion detector or by breaking an invisible beam of light or other radiation, to determine unauthorized ingress or egress and cause the alarm to activate.

One type of alarm system which utilizes the movement of a door to indicate unauthorized passage through the passageway that is secured by the door comprises a pair of cooperating magnets which are connected to a control panel having an alarm. One of the magnets is placed on the non-moving frame around the door and the other magnet is placed in cooperating relation on the door such that when the door is closed the magnets are disposed next to each other and the alarm is silent. Opening the door displaces the door magnet from the frame magnet and causes the control panel to activate the alarm. Often, this type of alarm system is provided with a delay circuit such that the alarm does not sound for a preset amount of time. The alarm can be deactivated when the threat no longer exists or has passed. Typically, these alarms are provided with a pass through feature allowing a person to enter a code, push a button or perform some other task to prevent the alarm from sounding. Another type of alarm system that utilizes the opening of a door to activate an alarm is the type that operates in conjunction with the mechanism which opens the door, such as an emergency exit bar. If the alarm system is not deactivated, an alarm will sound when a person utilizes the opening mechanism. Many of these types of alarm systems utilize a mechanical activation mechanism to sound the alarm. The emergency exit bar of U.S. Pat. No. 5,517,176 to Lavell, et al. utilizes an infrared beam that is directed along the front of the exit bar. Interruption of the beam causes the alarm to sound. A number of other types of alarm systems utilize the opening of a door or window to sound an alarm.

There are a number of alarm systems that do not depend on the opening of a door or window to indicate that an unauthorized person is passing through the passageway to activate an alarm. One common type alarm system utilizes a beam of infrared energy transmitted across the passageway and the interruption of that beam to indicate that a person or other object is passing through the passageway. Typically, such alarm systems comprise an infrared transmitter on one side of the passageway and an infrared receiver on the opposite side of the passageway, with the beam of infrared energy transmitted between the transmitter and receiver. The infrared transmitter and receivers are usually mounted on or into the opposing sidewalls that define the passageway, such as on or in a door frame which supports a door. Examples of such systems are shown in U.S. Pat. No. 4,516,115 to Frigon, et al. and U.S. Pat. No. 6,255,946 to Kim. Infrared transmission and reflection are also utilized in garage door openings to indicate the presence of a person or object in the passageway who could be injured or which could be damaged by the closing of an automatic garage door. If the infrared beam is broken by a person or object, the downward movement of the garage door will stop and, typically, reverse direction to avoid injuring the person or damaging the object. Examples of such systems are shown in U.S. Pat. No. 4,922,168 to Waggamon, et al. and U.S. Pat. No. 5,656,900 to Michel, et al. Infrared beam transmission laterally across an open passageway is also utilized to detect movement of a person through the passageway, turn on lights or other devices inside a room in which a person has entered by passing through the passageway and then turn off such devices when the person exits the room and for similar monitoring uses. Often, these devices are configured with more than one infrared transmitter/receiver combination so the system can determine whether one or more people have entered the room and when the last person leaves the room and/or are configured to determine the direction the person is moving (i.e., in or out of the room). For such uses, the infrared transmitters/receivers are placed in side-by-side relation to indicate in and out movement through the passageway. Examples of such systems are shown in U.S. Pat. No. 4,719,363 to Gallacher and U.S. Pat. No. 6,255,946 to Kim.

One area that is commonly restricted to selective persons is a backyard pool. As well known, unfortunately, many drowning deaths occur each year due to a small child entering the pool area of a home when he or she is not authorized to be there, resulting in the child falling or otherwise entering the pool without supervision by an adult or other responsible person. Many municipalities have barrier code requirements that are intended to physically keep a child from entering the pool and/or sound an alarm if a child enters the pool without the alarm being deactivated. Many people utilize a fence around the pool to keep a child from the pool, with a gate having a locking mechanism to allow authorized persons to enter the pool area. Various pool alarms are also available for above-ground and in-ground pools that sound an alarm when someone enters the water. Examples of such alarms are the Poolguard® Inground Pool Alarm and the Poolguard® Above Ground Pool Alarm available from PBM Industries, Inc. This company also sells a Poolguard® Door Alarm that is of the type described above which utilizes a pair of adjacent magnets to activate an alarm upon the opening of a door that, for use with their product, leads to a pool area.

One problem with the presently available pool alarm systems is that they are activated in response to the activity which sets off the alarm, such as a door opening, motion in the pool or a person walking through the door, regardless of whether the person causing the activity is a child or not. As is well known, it is generally not necessary to have an alarm system for most people who are likely to utilize the pool, such as adults and older children. The need and primary use of such alarm systems is to protect younger children who are not likely to know how to swim or do not swim well enough to be left on their own around or in the pool. As a result, most prior art pool alarm systems, whether they operate at the door, gate or in the pool, have a mechanism that allows adults and older children to pass through to the pool without activating the alarm. Such mechanisms are particularly useful when there is a number of people, some of whom are younger children, who will be moving between the inside of the house and the pool located outside the house, such as will occur during a party or the like. Unfortunately, it is somewhat common for the pool alarm system to become annoying to adults or older children, who tend to get frustrated with the need to bypass the alarm system every time they want to go outside the house. In addition, often a person in a house desires to leave open a door, which may lead to a pool, as he or she passes through the door carrying items between the house and pool or to take advantage of a breeze. As a result, these alarm systems often get turned off or otherwise not utilized. The rationale usually is that the young child who needs protecting either knows better than to go outside or he or she can be sufficiently watched to ensure they stay inside. The result of such assumptions can be tragic. If an alarm system could distinguish between a child walking through the door or other passageway leading to a pool and an adult or older child who walks through that passageway, then the alarm system could be left on all of the time to protect against drownings.

As also well known, pools are not the only dangerous area around a home or other building for young children. A child can be injured or killed if he or she runs out of the house and enters the street in front of a house, follows a person to their car in the driveway or climbs on equipment or materials that are stored along the side of the house, among other potentially dangerous activity. Often the child will be able to access the dangerous area because the door is intentionally left open for an adult or older child to pass through as he or she is carrying groceries or other items, to take advantage of a breeze or while waiting for someone to approach the building or because the door is unintentionally left open due to carelessness or faulty operation of the door closing mechanism. As with pool alarms, if an alarm system could distinguish between small children and adults or older children passing through a door or other passageway, then it could be utilized at any passageway that leads to a potentially dangerous area and be kept in the alarm mode all of the time.

What is needed, therefore, is an improved alarm system that is configured to activate an alarm or cause other action when a person or an object of a certain height passes through a passageway but does not activate the alarm or cause the other action when a person or an object of a different height passes through the passageway. For use as a pool alarm system, the alarm system should be configured to activate an alarm, preferably an audible alarm, when a child passes through a passageway that leads to a pool, but not activate the alarm when an adult or an older child passes through the passageway. The alarm system must be able to effectively and quickly distinguish between a small child and an adult or older child to determine if an alarm should sound to warn persons that a child has exited a safe area and entered a potentially dangerous area, such as a pool or the like. Such an alarm system should be configured to operate in any type of passageway, whether the passageway is defined by a door frame or not. Preferably, the alarm system should be relatively simple to install, easy to operate and inexpensive to manufacture.

SUMMARY OF THE INVENTION

The improved alarm system for passageways of the present invention solves the problems and provides the benefits identified above. That is to say, the present invention discloses an improved alarm system which can be installed and utilized in virtually any type or configuration of passageway to activate an alarm or take other action with regard to a person or an object of a certain height passing through the passageway and not activate the alarm or take the action with regard to a person of a different height passing through the passageway. In one embodiment, the improved alarm system of the present invention is configured for use as a pool alarm that sounds an alarm when a child passes through a door or other passageway leading to a pool but does not sound the alarm if an adult or older child passes through the passageway. Because the alarm system of the present invention distinguishes between a child and an adult passing through the passageway in with which it is utilized, the alarm system can be kept in its on or ready state at all times to warn of a child entering the pool area. The improved alarm system of the present invention can operate in virtually any type of passageway, including those defined by a door frame or the like, to effectively and quickly distinguish whether it is a small child or an adult or older child who is passing through the passageway and, if it is a small child, activate an alarm to warn others that the child is exiting a safe area and entering a potentially dangerous area, such as a pool or the like. In a preferred embodiment of the present invention, the improved alarm system comprises commonly available components and utilizes well established infrared beam technology, adapted for the present invention, to distinguish between when a young child is passing through a passageway and when an adult or older child is passing through the passageway. The alarm system of the present invention is simple to install, easy to use and relatively inexpensive to manufacture.

In a primary embodiment of the present invention, the improved alarm system comprises a lower passage indicator means, an upper passage indicator means and a control means that are cooperatively configured to monitor ingress and egress through a passageway defined by at least a first sidewall and a second sidewall. The lower passage indicator means is disposed generally toward the lower end of the first sidewall and generally toward the lower end of the second sidewall for indicating passage through the passageway by a child or an adult. The upper passage indicator means is disposed generally toward the upper end of the first sidewall and generally toward the upper end of the second sidewall for indicating passage through the passageway by the adult. The upper passage indicator means is sufficiently spaced above the lower passage indicator means so it does not indicate passage through the passageway of a child, due to the height of the child as opposed to the adult. The control means is operatively connected to each of the lower passage indicator means and the upper passage indicator means for determining whether passage through the passageway is by the child or by the adult. The control means is configured to generate a signal, typically an alarm signal, when passage through the passageway is by the child but not to generate the signal when passage through the passageway is by the adult. The alarm system of the present invention can be utilized with virtually any passageway to distinguish between a child passing through the passageway and an adult passing through the passageway.

In a preferred embodiment of the alarm system of the present invention, which is particularly beneficially utilized to monitor access through a passageway, having at least a first sidewall and a second sidewall, leading to a pool or other dangerous area, the alarm system comprises a combination first emitter/receiver and first reflector, a combination second emitter/receiver and second reflector and a control unit. The first reflector is disposed generally toward the lower end of the second sidewall and the first emitter/receiver is disposed generally toward the lower end of the first sidewall in corresponding relation to the first reflector. The first emitter/receiver is configured to emit a first beam across the passageway toward the first reflector. The first reflector and the first emitter/receiver are positioned so the first beam is interrupted by a child or an adult who is passing through the passageway. The second reflector is disposed generally toward the upper end of the second sidewall in spaced apart relation to the first reflector. The second emitter/receiver is disposed generally toward an upper end of the first sidewall in corresponding relation to the second reflector. The second emitter/receiver is configured to emit a second beam across the passageway toward the second reflector. The second reflector and the second emitter/receiver are positioned so the second beam is interrupted only by an adult passing through the passageway and not by a child passing through the passageway. The control unit has a user interface, a controller and an alarm that are enclosed in a housing. The controller is operatively connected to the user interface and to each of the first emitter/receiver and the second emitter/receiver. The alarm is operatively connected to the controller and is configured to generate an alarm signal, preferably at least an audible alarm signal that can be heard throughout the house. The controller is configured to analyze whether the first beam alone is interrupted, indicating a child is passing through the passageway, or whether each of the first beam and the second beam are both interrupted, indicating an adult is passing through the passageway. The control mechanism is configured to generate the alarm signal, or take other action, when passage through the passageway is by the child and to not generate the alarm signal, or take such other action, when passage through the passageway is by the adult. One of the main benefits of the present invention is that people are more likely to use the alarm system compared to prior art alarm systems due to it having a much less likelihood of false alarms and not requiring the alarm system to be turned off or bypassed for an adult to pass through the passageway.

Accordingly, one of the primary aspects of the present invention is to provide an improved alarm system that has the advantages discussed above and which overcomes the disadvantages and limitations associated with presently available alarm systems.

It is an important aspect of the present invention to provide an alarm system that can be installed in a passageway, such as a doorway or the like, that leads to a dangerous area or from a safe or controlled area which can quickly and effectively distinguish between a small child passing through the passageway and an adult or an older child passing through the passageway and sound an alarm if it is a small child.

It is also an important aspect of the present invention to provide an improved alarm system that can be utilized as a pool alarm to sound an audible alarm or take other action if the alarm system determines a small child is passing through a passageway leading to the pool, but which does not sound the alarm or take other action if an adult passes through the passageway.

Another important aspect of the present invention is to provide an improved alarm system for passageways that can be utilized in virtually any type or configuration of passageway to activate an alarm signal if a small child passes through the passageway but which does not activate the alarm signal if an adult or an older child passes through the passageway.

Yet another important aspect of the present invention is to provide an improved alarm system that, in a preferred embodiment, utilizes commonly available infrared beam technology and components strategically positioned in a passageway to selectively sound an alarm if a small child passes through the passageway without sounding the alarm if an adult or older child passes through the passageway.

The above and other aspects and advantages of the present invention are explained in greater detail by reference to the attached figures and the description of the preferred embodiment which follows. As set forth herein, the present invention resides in the novel features of form, construction, mode of operation and combination of the above presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed text and drawings are merely illustrative of one or more preferred embodiments and, as such, disclose one or more different ways of configuring the present invention. Although specific components, materials, configurations and uses are illustrated, it should be understood that a number of variations to the components and to the configuration of those components described herein and in the accompanying figures can be made without changing the scope and function of the invention set forth herein. For instance, although the figures and description provided herein are generally directed to use of the improved alarm system of the present invention in a doorway to indicated passage of a person to a pool area or the like, those skilled in the art will readily understand that this is merely for purposes of simplifying the present disclosure and that the present invention is not so limited. As set forth below, the improved alarm system of the present invention can be utilized with many different types of passageways and to indicate passage to or from a wide variety of different areas, including homes, businesses and the like.

Figure 1:
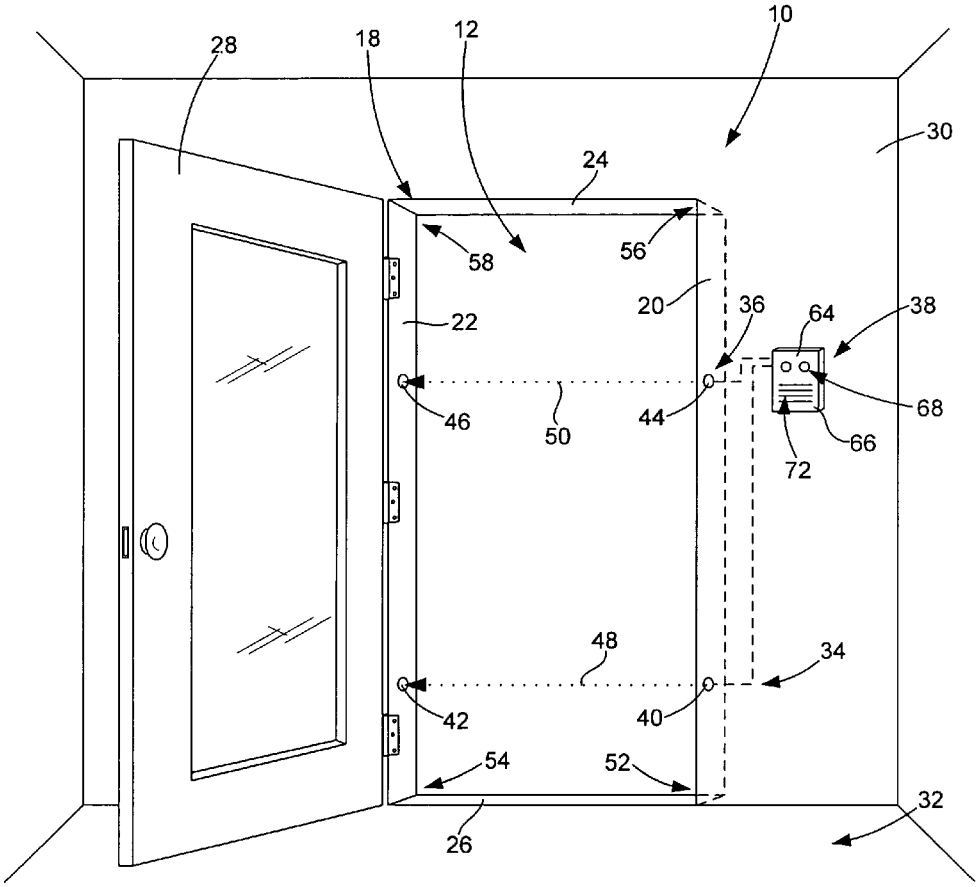
FIG. 1 is a perspective view of a passageway having the improved alarm system of the present invention utilized therewith showing both the lower and upper passage indicators in use with infrared beams directed laterally across the passageway.
Figure 2:
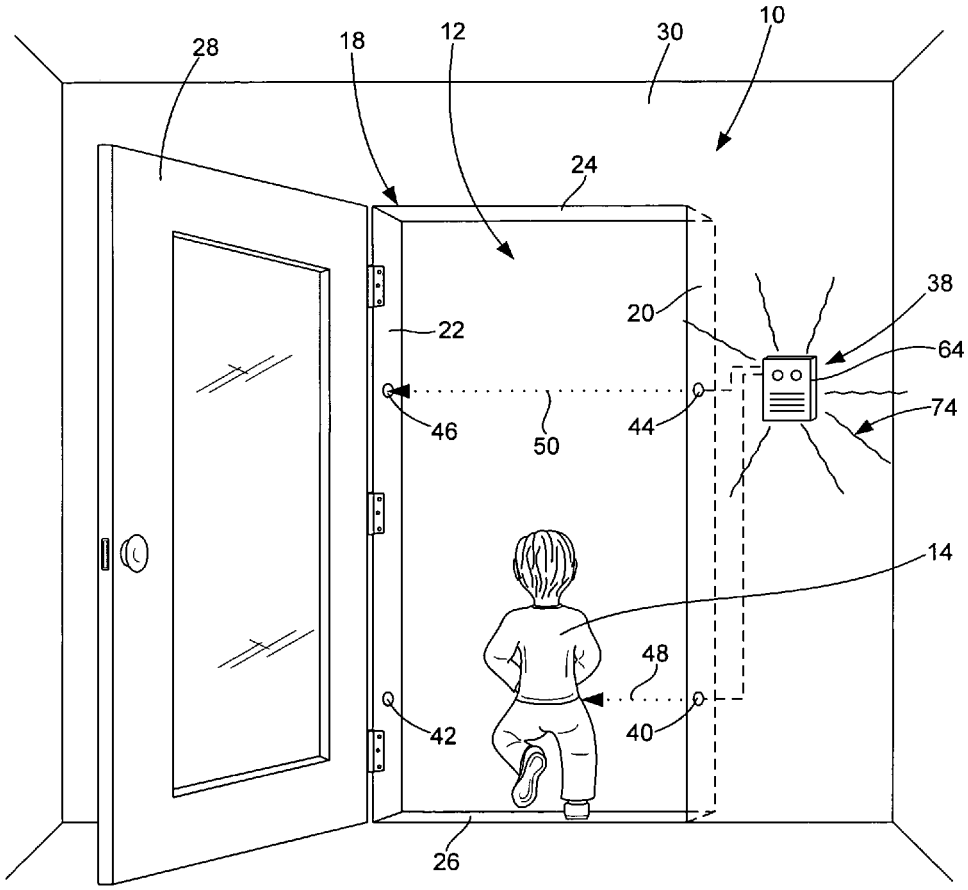
FIG. 2 illustrates a small child passing through the passageway of FIG. 1 having the improved alarm system of the present invention showing the child breaking the infrared beam of the lower passage indicator and sounding the alarm disposed in the controller unit.
Figure 3:
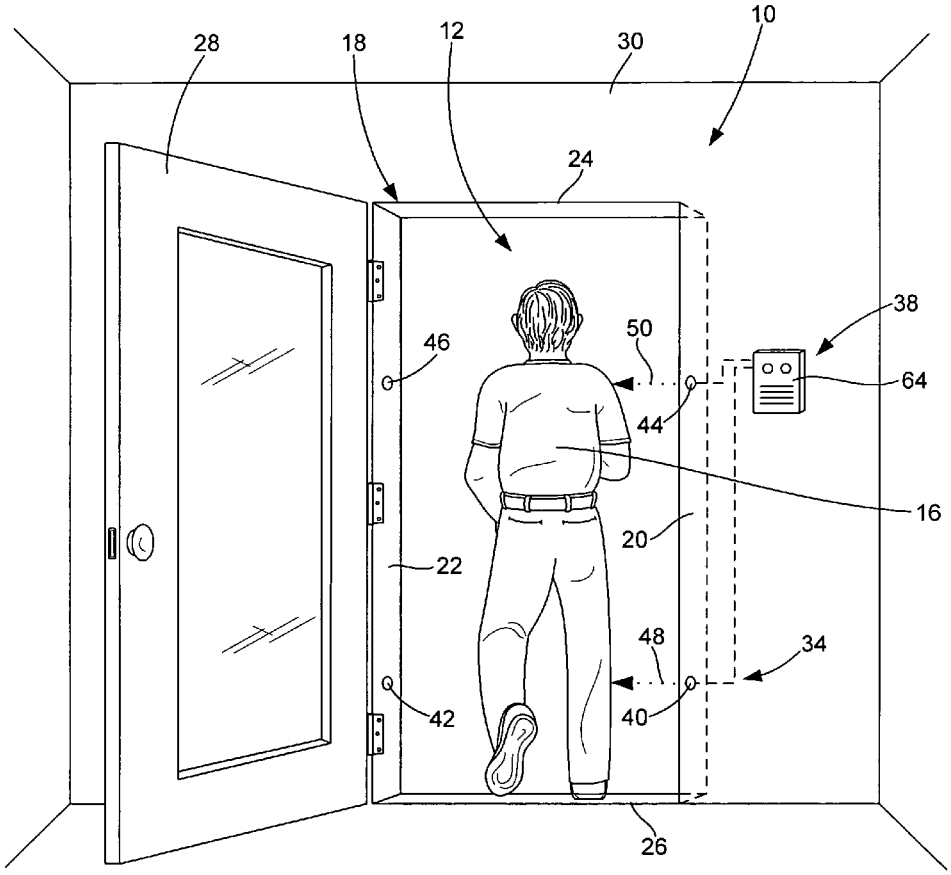
FIG. 3 illustrates an adult or older child passing through the passageway of FIG. 1 having the improved alarm system of the present invention showing the adult or older child breaking the infrared beams of both the lower and upper passage indicators.

An improved door alarm system that is configured pursuant to a preferred embodiment of the present invention is identified generally as 10 in FIGS. 1 through 3. As shown in these figures, alarm system 10 is configured for use with a passageway 12 to indicate passage of a person, such as a small child 14 (FIG. 2) or an adult 16 (FIG. 3) through the passageway 12. The passageway 12 shown in the figures is defined by a door frame 18 having a first door jamb or sidewall 20, a second door jamb or sidewall 22, a lintel or top frame member 24 and a sill or bottom frame member 26. The door frame 18 pivotally supports door 28 that is sized and configured to close passageway 12. Typically, door frame 18 is made out of wood or like materials and mounted in wall 30, which substantially encloses door frame 18 on three sides, with the floor 32 enclosing the bottom of door frame 18. As will be readily apparent to those skilled in the art, however, alarm system 10 of the present invention is not limited to such a configuration for passageway 12. As set forth the Background, the passageway 12 can be any opening or space between a pair of sidewalls, whether defined by a door frame 18 or not, that leads to an area that a person must walk through the passageway 12 to reach. In one embodiment, passageway 12 is configured with just the first 20 and second 22 sidewalls, having neither a top frame member 24 nor a bottom frame member 26, such as is common for an opening in a gate, fence, wall or like structures. When there is no door frame 18, the components of alarm system 10 can be mounted on or in the sidewalls of the wall 30 or the other sidewalls which define the passageway 12 through which a child 14 or an adult 16 will pass.

The area which passage into or from will be monitored by the alarm system 10 can be any type of area that requires a person, such as the child 14 or adult 16, to walk through passageway 12 in order to get to the area or to leave from the area. In a preferred embodiment, the alarm system 10 of the present invention is utilized with a house to monitor one or more passageways 12 out of the house that lead to the backyard pool, the street or driveway in the front of the house or to other areas that may be potentially dangerous for a child 14. As set forth in more detail below, because the alarm system 10 distinguishes between when it is a child 14 or an adult 16 (for purposes of the present disclosure, the term "adult" includes an older child) who is exiting the house through passageway 12, the alarm system 10 can be left on in its ready state at all times to monitor unauthorized passage by the child 14 through passageway 12. The adult 16 will not need to turn off or bypass the alarm system 10 when he or she passes through passageway 12 or desires to keep the door 28 open for ease of carrying items into the house or to allow a breeze to pass through the house. Likewise, when there is a party or other gathering of a number of people at the house, there will be no need to turn off the alarm system 10 to avoid the occurrence of false alarms. The exit of any child 14 from the house through the passageway 12 will be monitored at all times while the adults 16 will be able to pass through the passageway 12 without setting off the alarm.

The alarm system 10 for passageways 12 of the present invention generally comprises a lower passage indicator mean 34, an upper passage indicator means 36 and a control means 38 that is operatively connected to each of the lower passage indicator means 34 and upper passage indicator means 36 to monitor passageway 12 for passage of a child 14 or adult 16. In a preferred embodiment, lower passage indicator means 34 comprises a first emitter/receiver 40 and a first reflector 42 and upper passage indicator means 36 comprises a second emitter/receiver 44 and a second reflector 46, as shown in FIGS. 1 through 3. The first emitter/receiver 40 is configured to emit a first beam 48 of invisible energy, such as an infrared beam, that is reflected back to it by first reflector 42. The second emitter/receiver 44 is configured to emit a second beam 50 of invisible energy, such as an infrared beam, that is reflected back to it by second reflector 46. The first 40 and second 44 emitter/receivers are each configured to generate a beam of invisible energy, such as first beam 48 and second beam 50, respectively, and direct the beam of energy laterally across the passageway 12 to effectively create a lower barrier and an upper barrier, by first beam 48 and second beam 50, that is broken by movement of an object or person through the passageway 12. When passageway 12 is being monitored and no one is passing through the passageway 12, the first beam 48 is reflected back to the first emitter/receiver 40 and the second beam 50 is reflected back to the second emitter/receiver 44, as shown in FIG. 1. The passage of a person through passageway 12 breaks the lower barrier and/or the upper barrier formed by the first beam 48 and/or second beam 50, depending on whether the person passing through passageway 12 is a child 14 or adult 16, as shown in FIGS. 2 and 3 and summarized in FIG. 5. The general components and configuration necessary for emitter/receivers 40/44 and their corresponding reflectors 42/46 to transmit a beam 48/50 of invisible energy across an open space, such as passageway 12, are well known within art. Prior art systems, however, make no distinction between whether the person passing through the open area is a child 14 or adult 16.

As shown in FIGS. 1 through 3, the first emitter/receiver 40 is placed generally toward the lower end 52 of the first sidewall 20 and the first reflector 42 is placed in cooperating, generally aligned, relationship toward the lower end 54 of the second sidewall 22 and the second emitter/receiver 44 is placed generally toward the upper end 56 of the first sidewall 20, somewhat above the position of the first emitter/receiver 40, and the second reflector 46 is placed in cooperating, generally aligned, relationship with the second emitter/receiver 44 toward the upper end 58 of the second sidewall 22. The first emitter/receiver 40 and first reflector 42 of the lower passage indicator means 34 are configured such that the first beam 48 from first emitter/receiver 40 will hit the first reflector 42 and reflect back to the first emitter/receiver 40 when there is nothing in the passageway 12 to interrupt the first beam 48. The second emitter/receiver 44 and second reflector 46 of the upper passage indicator means 36 are configured such that the second beam 50 from second emitter/receiver 44 will hit the second reflector 46 and reflect back to the second emitter/receiver 44 when there is nothing in the passageway 12 to interrupt second beam 50. As well known in the art, the transmission and reflection of the first beam 48 and the second beam 50 across the passageway 12 completes a circuit that indicates an open passageway 12. As summarized in FIG. 4, the first emitter/receiver 40 sends a first indicator signal 60 to the control means 38 indicating the status of first beam 48, whether it is broken or not, and the second emitter/receiver 44 sends a second indicator signal 62 to the control means 38 indicating the status of second beam 50, whether it is broken or not. As set forth below, control means 38 analyzes the first 60 and second 62 indicator signals to determine whether no one is passing through the passageway 12 (i.e., it is completely open) or whether a child 14 or an adult 16 is passing through passageway 12 and an alarm needs to sound.

Figure 4:
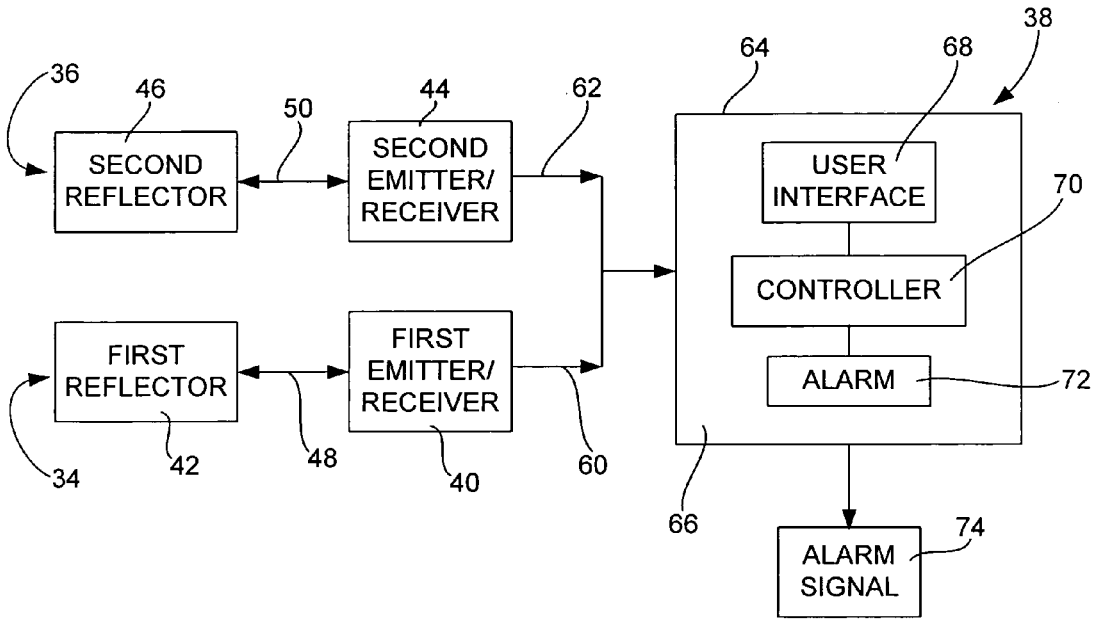
FIG. 4 is a block diagram of the improved alarm system of the present invention.

In the preferred embodiment of alarm system 10 of the present invention, control means 38 comprises a control unit 64 having a housing 66 that encloses and supports a user interface 68, controller 70 and an alarm 72 (which emits an alarm signal 74), as best shown in FIG. 4. As shown in FIGS. 1 through 3, the first emitter/receiver 40 and the second emitter/receiver 44 are operatively connected to control means 38. Although the embodiment shown in the figures utilizes a wired connection, those skilled in the art will readily know that various wireless connections, including Bluetooth® and the like, can be utilized to connect the first 40 and second 44 emitter/receivers to the control means 38. In a preferred embodiment, the user interface 68 comprises one or more externally accessible buttons and/or other user control components, such as a display screen or a touch-operated screen, that allows the user to turn off the alarm signal 74 once the danger (i.e., child 14 passing through passageway 12) has been addressed. If desired, the user interface 68 can also include a device, such as a button or code, that is activated to turn the alarm 72 off when it will not be needed, as for instance when a group of children are over with an adult or lifeguard by the pool and the children will be frequently going in and out of passageway 12 to use the restroom or obtain food and/or drinks inside the house. Typically, however, the alarm system 10 of the present invention will always be on. If desired, the user interface 68 can also indicate the number of passages through the passageway 12 and/or information such as time, temperature and the like. The controller 70 will typically have one or more microprocessors and other circuitry that interact with the user interface 68 and continually analyze the status of first beam 48 and second beam 50 to determine if a child 14 is passing through passageway 12 and, if so, send a signal to alarm 72 to activate and issue the alarm signal 74. In a preferred embodiment, the alarm 72 is of the type that issues an audible alarm signal 74 which is sufficiently loud to be heard throughout the house or building in which the alarm system 10 is utilized.

Although the preferred embodiment of alarm system 10 includes each of the user interface 68, controller 70 and alarm 72 enclosed in the same housing 66 of control unit 64, these components can be separated into individual units that are located at places other than next to the passageway 12 that is shown in FIGS. 1 through 3. For instance, a house could be set up with a control unit 64 near each passageway 12 to be monitored and these can be connected to a central control system (not shown) located in a main living area of the house so the user can control any of the alarm systems 10 in the house. Alternatively, the central control system could be the only control unit 64 in the house to exclusively control each passageway 12 from a single location. In addition, as will be readily understood by those skilled in the art, the alarm 72 can be somewhat remote from the passageway 12 or multiple alarms 72 can be connected to control means 38 to sound throughout the house. Alternatively or in addition to an audible alarm, the alarm signal 74 can be a light or other type of signal that notifies others that a child 14 is passing through passageway 12. In addition to setting off an audible or visual alarm signal 74, or as an alternative thereto, the controller or alarm 72 can be configured to take other action, such as activating a locking mechanism at a gate or other door that must be accessed to enter the pool area, when alarm system 10 indicates that a child 14 is exiting the house through passageway 12 to prevent the child 14 from getting to the pool or other dangerous area.

As shown in the figures, the first emitter/receiver 40 and first reflector 42 of the lower passage indicator means 34 are positioned generally toward the lower ends 52/54 of first 20 and second 22 sidewalls that define passageway 12 and the second emitter/receiver 44 and second reflector 46 of the upper passage indicator means 36 are positioned generally toward the upper ends 56/58 of first 20 and second 22 sidewalls. The emitter/receiver 40 and reflector 42 of lower passage indicator means 34 should be positioned sufficiently above the lower ends 52/54 of sidewalls 20/22 to allow a dog, cat or other pet to ingress or egress through passageway 12 without breaking first beam 48 but low enough that any child 14 in the home will break the first beam 48 if he or she passes through passageway 12. Even if there is no pet, the lower passage indicator means 38 should be in sufficient spaced apart relation with the lower ends 52/54 of sidewalls 20/22 such that the child 14 will not step over first beam 48 and, even unintentionally, avoid breaking the first beam 48. In one embodiment, first emitter/receiver 40 and first reflector 42 are positioned approximately eighteen inches above the lower ends 52/54 of sidewalls 20/22 so the first beam 48 will be easily interrupted by the passing of a child 14 through passageway 12, as shown in FIG. 2. The emitter/receiver 44 and reflector 46 of upper passage indicator means 36 should be positioned sufficiently below the upper ends 56/58 of sidewalls 20/22 such that an adult 16 (or an older child) passing through passageway 12 will easily interrupt the second beam 50, in addition to interrupting first beam 48, as shown in FIG. 3. As set forth in more detail below, interrupting both the first beam 48 and the second beam 50 will indicate that an adult 16 is passing through passageway 12, instead of child 14, and the controller 70 will not cause the alarm 72 to issue an alarm signal 74. As shown in FIGS. 1 through 3, the emitter/receiver 44 and reflector 46 of the upper passage indicator means 36 are positioned in spaced apart relation to the emitter/receiver 42 and reflector 44 of the lower passage indicator means 34 such that a child 14 will only interrupt the first beam 48 when he or she passes through the passageway 12 and not interrupt the second beam 50 (e.g., not be tall enough). The spacing between the lower passage indicator means 34 and upper passage indicator means 36, or the positioning of the upper passage indicator means 36 itself, should be selected based on the height of the child 14 to be protected by alarm system 10. Interrupting only the first beam 48, thereby leaving the second beam 50 intact, will indicate that a child 14 is passing through passageway 12 and the controller 70 will send a signal to the alarm 72 to activate the alarm signal 74 to warn others of the danger for child 14. In one embodiment, the second emitter/receiver 44 and second reflector 46 of the upper passage indicator means 36 are positioned approximately fifty-six inches above the lower ends 52/54 of sidewalls 20/22, which is approximately thirty-eight inches above the first emitter/receiver 40 and first reflector 42 of lower passage indicator means 34. As stated above, various other positions for the components of the lower 34 and upper 36 passage indicator means may be more suitable or appropriate depending on the height of the child 14 to be protected and the adults or older children 16 who live in the home.

The components of the lower 34 and upper 36 passage indicator means can be installed in sidewalls 20/22 utilizing various commonly available methods of attaching such devices. In one embodiment, these components are attached to sidewalls 20/22 utilizing screws, bolts or other securing mechanisms that are suitable for the material that comprises sidewalls 20/22. In another embodiment, adhesives, hook-and-loop or other materials are utilized to secure the various components of the lower 34 and upper 36 passage indicator means to sidewalls 20/22. In yet another embodiment, these components are recessed into the sidewalls 20/22 or made integral with sidewalls 20/22 (i.e., included with door frame 18). As shown in FIGS. 1 through 3, the housing 66 of control unit 64 can be attached to the wall 30 next to the passageway 12 to be monitored using commonly available attachment mechanisms, including screws, bolts, adhesive and the like that is suitable for wall 30. As known in the art, other methods of associating the components of alarm system 10 with the passageway 12 to be monitored can also be utilized.

The user interface 68 and controller 70 can be configured to assist the user with installing the alarm system 10 in passageway 12 by indicating when the first reflector 42 is sufficiently aligned with the first emitter/receiver 40 such that first beam 48 causes the first indicator signal 60 to be sent to the control means 38 and when the second reflector 46 is sufficiently aligned with second emitter/receiver 44 such that second beam 50 causes the second indicator signal 62 to be sent to the control means 38. Other means of properly aligning these components can also be utilized. In use, the controller 70 is configured to receive and analyze the first indicator signal 60 from the first emitter/receiver 40 and receive and analyze the second indicator signal 62 from the second emitter/receiver 44. If the controller 70 receives both signals 60/62, indicating that both the first beam 48 and second beam 50 are intact, it will determine that no one is passing through passageway 12, as shown in FIG. 1. If the controller 70 receives the second indicator signal 62 but not the first indicator signal 60, it will determine that a child 14 is passing through the passageway 12, as shown in FIG. 2, and send a command to alarm 72 to initiate the alarm signal 74 and warn others in the house that the child 14 is in danger. If the controller 70 does not receive either the first indicator signal 60 and the second indicator signal 62, it will determine that an adult 16 is passing through the passageway 12, as shown in FIG. 3, and not initiate the alarm signal 74. In one embodiment, the controller 70 looks for both the first 60 and second 62 indicator signals at the same time. In a preferred embodiment, however, the controller 70 includes a delay circuit that delays issuing the command to the alarm 72 to initiate the alarm signal 74 after noting the first beam 48 has been interrupted for a preset delay period, such as three to ten seconds, to allow for an adult 16 who is following immediately behind the child 14 or for an adult 16 who is not walking entirely upright. The use of the delay period will reduce the likelihood of false alarms from a child 14 going outside with an adult 16 and reduce the annoyance of the alarm signal 74 going off when the adult 16 is merely not passing through the first 48 and second 50 beams simultaneously.

Figure 5:
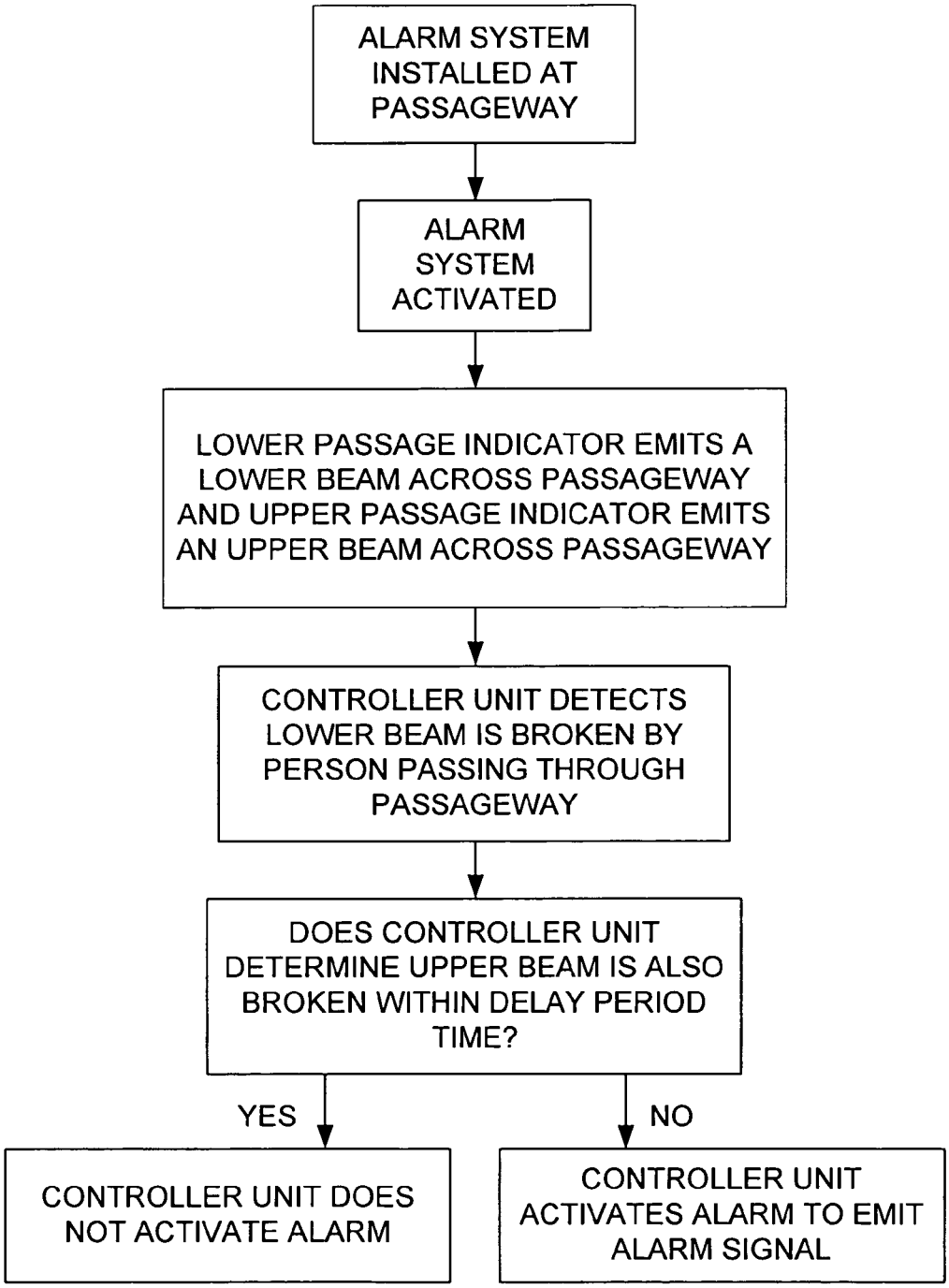
FIG. 5 is a flow chart showing the operation of the improved alarm system of the present invention.

The use of alarm system 10 of the present invention is summarized in FIG. 5. Initially, the user or someone on his or her behalf installs the alarm system 10 at the passageway 12 where monitoring of a child 14 passing through the passageway 12 is desired, such as at the rear door of a house leading to a backyard pool. The alarm system 10 is activated, typically by entering the necessary commands at the user interface 68 of the control means 38. Once activated, the lower passage indicator means 34 will emit a first or lower beam 48 laterally across the passageway 12 and the upper passage indicator means 36 will emit a second or upper beam 50 laterally across passageway 12. When no one is passing through passageway 12, the control means 38 will receive both the first 60 and second 62 indicator signals indicating the first 48 and second 50 beams are intact, as shown in FIG. 1. No command will be sent to the alarm 72 to activate the alarm signal 74. If a child 14 passes through passageway 12, as shown in FIG. 2, the first beam 48 will be interrupted and the second beam 50 will be intact. Because a child 14 is passing through passageway 12, the second beam 50 will not be interrupted during the delay period. From the state of the first 60 and second 62 indicator signals, the controller 70 of control means 38 will determine that a child 14 is passing through the passageway 12 and issue a command to the alarm 72 to activate the alarm signal 74 so other persons may take appropriate action. When the danger is passed, the user can turn off the alarm signal 74 by accessing the user interface 68 of the control unit 64. If an adult 16 is passing through passageway 12, as shown in FIG. 3, he or she will interrupt both the first 48 and second 50 beams, either simultaneously or within the delay period. Because both beams 48/50 are interrupted, the controller will determine that an adult 16 is passing through passageway 12 and not send a command to the alarm 72 to activate the alarm signal 74. As such, the alarm system 10 of the present invention will quickly and effectively distinguish between a child 14 and an adult 16 passing through passageway 12. One of the primary benefits of the alarm system 10 of the present invention, compared to prior art alarm systems, is that it will be utilized and left on in the ready state as opposed to being turned off due to annoying false alarms or due to the desire of adults 16 to pass through the passageway 12 without setting off the alarm signal 74.

While there are shown and described herein specific forms of the invention, it will be readily apparent to those skilled in the art that the invention is not so limited, but is susceptible to various modifications and rearrangements in design and materials without departing from the spirit and scope of the invention. In particular, it should be noted that the present invention is subject to various modification with regard to any dimensional relationships set forth herein and modifications in assembly, materials, size, shape and use. For instance, there are numerous components described herein that can be replaced with equivalent functioning components to accomplish the objectives of the present invention.

What is claimed is:

1. An alarm system for a passageway defined by a first sidewall and a second sidewall, said alarm system comprising:

lower passage indicator means disposed generally toward a lower end of said first sidewall and generally toward a lower end of said second sidewall for indicating passage through said passageway by a child or an adult;

upper passage indicator means disposed generally toward an upper end of said first sidewall and generally toward an upper end of said second sidewall for indicating passage through said passageway by the adult, said upper passage indicator means sufficiently spaced above said lower passage indicator means so as to not indicate passage through said passageway by the child; and control means operatively connected to each of said lower passage indicator means and said upper passage indicator means for determining whether passage through said passageway is by the child or by the adult, said control means configured to generate a signal when passage through said passageway is by the child and to not generate said signal when passage through said passageway is by the adult.

2. The alarm system of claim 1, wherein said control means comprises a control unit having a user interface, a controller operatively connected to said user interface and to each of said lower passage indicator means and said upper passage indicator means, and an alarm operatively connected to said controller and configured to generate said signal.

3. The alarm system of claim 1, wherein said lower passage indicator means emits a first beam across said passageway and said upper passage means emits a second beam across said passageway, said control means configured to determine when said first beam is interrupted and when each of said first beam and said second beam are interrupted so as to determine whether the child or the adult is passing through said passageway.

4. The alarm system of claim 3, wherein said lower passage indicator means comprises a first emitter/receiver configured to emit said first beam across said passageway and a first reflector in corresponding relation to said first emitter/receiver to reflect said first beam to said first emitter/receiver and said upper passage indicator means comprises a second emitter/receiver configured to emit said second beam across said passageway and a second reflector in corresponding relation to said second emitter/receiver to reflect said second beam to said second emitter/receiver.

5. The alarm system of claim 4, wherein said first emitter/receiver is aligned with said first reflector to direct said first beam laterally across said passageway and said second emitter/receiver is aligned with said second reflector to direct said second beam laterally across said passageway.

6. The alarm system of claim 1, wherein said signal is an alarm signal generated by an alarm operatively connected to said control means.

7. The alarm system of claim 1, wherein said signal is an alarm signal generated by an alarm integral with said control means.

8. The alarm system of claim 1, wherein said signal is an audible alarm.

9. The alarm system of claim 1, wherein each of said first passage indicator means and said second passage indicator means are attached to said first sidewall and said second sidewall.

10. The alarm system of claim 1, wherein each of said first passage indicator means and said second passage indicator means are integral with said first sidewall and said second sidewall.

11. An alarm system for a passageway defined by a first sidewall and a second sidewall, said alarm system comprising:

a first reflector disposed generally toward a lower end of said second sidewall;

a first emitter/receiver disposed generally toward a lower end of said first sidewall in corresponding relation to said first reflector and configured to emit a first beam across said passageway toward said first reflector, said first reflector and said first emitter/receiver positioned so said first beam is interrupted by a child or an adult passing through said passageway;

a second reflector disposed generally toward an upper end of said second sidewall in spaced apart relation to said first reflector;

a second emitter/receiver disposed generally toward an upper end of said first sidewall in corresponding relation to said second reflector and configured to emit a second beam across said passageway toward said second reflector, said second reflector and said second emitter/receiver positioned so the second beam is interrupted only by the adult passing through said passageway and not by the child; and control means operatively connected to each of said first emitter/receiver and said second emitter/receiver for determining whether passage through said passageway is by the child or by the adult, said control means configured to generate a signal when passage through said passageway is by the child and to not generate said signal when passage through said passageway is by the adult.

12. The alarm system of claim 11, wherein said control means comprises a control unit having a user interface, a controller and an alarm, said controller operatively connected to said user interface and to each of said first emitter/receiver and said second emitter/receiver, said alarm operatively connected to said controller and configured to generate said signal.

13. The alarm system of claim 11, wherein said signal is an alarm signal generated by an alarm operatively connected to said control means.

14. The alarm system of claim 11, wherein said signal is an alarm signal generated by an alarm integral with said control means.

15. The alarm system of claim 11, wherein said signal is an audible alarm.

16. The alarm system of claim 11, wherein each of said first emitter/receiver and said second emitter receiver are attached to said first sidewall and each of said first reflector and said second reflector are attached to said second sidewall.

17. The alarm system of claim 11, wherein each of said first emitter/receiver and said second emitter receiver are integral with said first sidewall and each of said first reflector and said second reflector are integral with said second sidewall.

18. An alarm system for a passageway defined by a first sidewall and a second sidewall, said alarm system comprising:

a first reflector disposed generally toward a lower end of said second sidewall;

a first emitter/receiver disposed generally toward a lower end of said first sidewall in corresponding relation to said first reflector and configured to emit a first beam across said passageway toward said first reflector, said first reflector and said first emitter/receiver positioned so said first beam is interrupted by a child or an adult passing through said passageway;

a second reflector disposed generally toward an upper end of said second sidewall in spaced apart relation to said first reflector;

a second emitter/receiver disposed generally toward an upper end of said first sidewall in corresponding relation to said second reflector and configured to emit a second beam across said passageway toward said second reflector, said second reflector and said second emitter/receiver positioned so the second beam is interrupted only by the adult passing through said passageway and not by the child; and a control unit having a user interface, a controller and an alarm enclosed in a housing, said controller operatively connected to said user interface and to each of said first emitter/receiver and said second emitter/receiver, said alarm operatively connected to said controller and configured to generate an alarm signal, said controller configured to analyze whether said first beam alone is interrupted or whether each of said first beam and said second beam are interrupted to determine whether passage through said passageway is by the child or by the adult, said control unit configured to generate said alarm signal when passage through said passageway is by the child and to not generate said alarm signal when passage through said passageway is by the adult.

19. The alarm system of claim 18, wherein said signal is an audible alarm.

20. The alarm system of claim 18, wherein each of said first emitter/receiver and said second emitter receiver are attached to said first sidewall and each of said first reflector and said second reflector are attached to said second sidewall.

* * * * *